US010466620B2

(12) United States Patent
Fujita et al.

(10) Patent No.: US 10,466,620 B2
(45) Date of Patent: Nov. 5, 2019

(54) IMAGE FORMING APPARATUS AND IMAGE FORMING METHOD

(71) Applicant: Konica Minolta, Inc., Tokyo (JP)

(72) Inventors: Michiyo Fujita, Tokyo (JP); Makoto Nomiya, Tokyo (JP); Tomomi Oshiba, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/994,344

(22) Filed: May 31, 2018

(65) Prior Publication Data

US 2018/0348668 A1 Dec. 6, 2018

(30) Foreign Application Priority Data

Jun. 2, 2017 (JP) ..... 2017-110095
Mar. 23, 2018 (JP) ..... 2018-056433

(51) Int. Cl.
*G03G 15/08* (2006.01)

(52) U.S. Cl.
CPC . *G03G 15/0865* (2013.01); *G03G 2215/0636* (2013.01)

(58) Field of Classification Search
CPC ..... G03G 15/0865; G03G 15/6585; G03G 2215/0636; G03G 2215/00801
See application file for complete search history.

(56) References Cited

FOREIGN PATENT DOCUMENTS

| | | | | |
|---|---|---|---|---|
| JP | H01200985 A | | 8/1989 | |
| JP | 2013-178452 | * | 9/2013 | ..... G03G 15/01 |
| JP | 2013178452 A | | 9/2013 | |
| JP | 2014157249 A | | 8/2014 | |

OTHER PUBLICATIONS

Extended European Search Report dated Sep. 26, 2018 from corresponding European Application No. 18175704.8.

* cited by examiner

*Primary Examiner* — Hoang X Ngo
(74) *Attorney, Agent, or Firm* — Lucas & Mercanti, LLP

(57) ABSTRACT

According to an image forming apparatus and an image forming method of the present invention, an image is formed by arranging powders 200 on a surface of a resin image composed of sheet S and a color toner layer (resin layer 100) arranged thereon. The image forming apparatus includes: a powder spraying section 98 for supplying powders 200 on the surface of resin layer 100 which is adjusted to be in a softened state; and rubbing roller 74 for rubbing, from a side of resin layer 100, the resin image to which powders 200 have been supplied.

26 Claims, 3 Drawing Sheets

IMAGE FORMING APPARATUS AND IMAGE FORMING METHOD

CROSS REFERENCE TO RELATED APPLICATIONS

The entire disclosures of Japanese Patent Application No. 2017-110095, filed on Jun. 2, 2017, and Japanese Patent Application No. 2018-056433, filed on Mar. 23, 2018, is incorporated herein by reference in its entirety.

BACKGROUND

Technological Field

The present invention relates to an image forming apparatus and an image forming method.

Description of Related Art

In the on-demand printing market, demands for spot color printing and high-value printing have been growing recently. Especially, demands for printing of images with adjusted texture, such as metallic printing and pearl printing, are particularly high, and thus various studies have been carried out.

As such a method, a method of transferring metal foil and/or resin-coated foil using toner as an adhesive layer has been studied. For example, a method of forming a toner image and bonding transfer foil only to a toner portion is known (Japanese Patent Application Laid-Open No. 01-200985, for example). In this method, however, there is a problem in which when foil is transferred only to part of an image, all the rest foil is wasted.

Meanwhile, a study has also been conducted for incorporating a luster pigment into toner. For example, a method of forming a metallic image only in a necessary portion by incorporating a luster pigment into toner is known (Japanese Patent Application Laid-Open No. 2014-157249, for example). In this method, however, required metallic appearance and/or pearlescent appearance cannot be obtained in some cases.

Further, a method of forming a metallic image by attaching paint powders to a toner image is known (Japanese Patent Application Laid-Open No. 2013-178452, for example). Although highly metallic images can be obtained by this method, it is difficult to obtain mirror-like and/or pearl-like images.

SUMMARY

An object of the present invention is to provide a novel technique for forming an image with adjusted texture, in particular, an image with mirror-like, pearl-like, or matt appearance in a desired portion.

To achieve the abovementioned object, the present invention according to an aspect provides [1] an image forming apparatus for forming an image by arranging powders on a surface of a resin image composed of a recording medium and a resin layer arranged thereon, including: a powder supply device for supplying the powders to a surface of the resin layer of the resin image in which the resin layer is adjusted to be in a softened state; and a rubbing device for rubbing, from a side of the resin layer, the resin image to which the powders have been supplied.

To achieve the abovementioned object, the present invention according to another aspect provides [12] an image forming method including: supplying powders to a surface of a resin layer of a resin image in which the resin layer is adjusted to be in a softened state, where the resin image is composed of a recording medium and the resin layer arranged thereon; and rubbing, from a side of the resin layer, the resin image to which the powders have been supplied.

[2] The image forming apparatus according to [1], wherein: the rubbing device includes a press for pressing the resin image from the side of the resin layer; and the press is configured so that a surface of the press is movable relative to the surface of the resin layer while pressing the resin image.

[3] The image forming apparatus according to [2], wherein the press is configured so as to be movable in a direction different from a conveying direction of the resin image being conveyed.

[4] The image forming apparatus according to [2], wherein the press is movable on the resin layer by a reciprocating motion.

[5] The image forming apparatus according to [2], wherein the press is flexible.

[6] The image forming apparatus according to [2], wherein the press is a sponge.

[7] The image forming apparatus according to [1], wherein the powders each have a flat particle shape.

[8] The image forming apparatus according to [1], wherein a minor axis of the powders is 0.2 to 3.0 μm.

[9] The image forming apparatus according to [1], wherein the powders are either metal powders or metal oxide powders, or both metal powders and metal oxide powders.

[10] The image forming apparatus according to [1], further comprising a softening device for softening the resin layer of the resin image which is to be rubbed by the rubbing device.

[11] The image forming apparatus according to [1], further comprising a powder collector for collecting the powders supplied to the surface of the resin layer.

[13] The image forming method according to [12], further comprising softening the resin layer of the resin image to be rubbed.

[14] The image forming method according to [12], wherein in the rubbing, a flexible part is used as a press for rubbing.

[15] The image forming method according to [12], wherein in the rubbing, a sponge is used as a press for rubbing.

[16] The image forming method according to [12], wherein the powders each have a flat particle shape.

[17] The image forming method according to [12], wherein a minor axis of the powders is 0.2 to 3.0 μm.

[18] The image forming method according to [12], wherein the powders are either metal powders or metal oxide powders, or both metal powders and metal oxide powders.

[19] The image forming method according to [12], further comprising collecting the powders supplied to the surface of the resin layer.

[20] The image forming method according to [12], wherein the powders are non-spherical powders.

[21] The image forming method according to [12], wherein the resin layer is adjusted to be in a softened state by adjusting a temperature of the resin layer to a softening temperature.

[22] An image forming apparatus for forming an image by arranging non-spherical powders on a surface of a resin image composed of a recording medium and a layer of a thermoplastic resin arranged on the recording medium, the apparatus comprising: a powder supply device for supplying the non-spherical powders to a surface of the layer of the resin image in which the layer is adjusted to a softening temperature; and a rubbing device for rubbing, from a side of the layer, the resin image to which the non-spherical powders have been supplied.

[23] An image forming method comprising: supplying non-spherical powders to a surface of a layer of a thermoplastic resin of a resin image in which the layer is adjusted to be in a softened state, the resin image being composed of a recording medium and the layer arranged on the recording medium; and rubbing, from a side of the layer, the resin image to which the non-spherical powders have been supplied.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
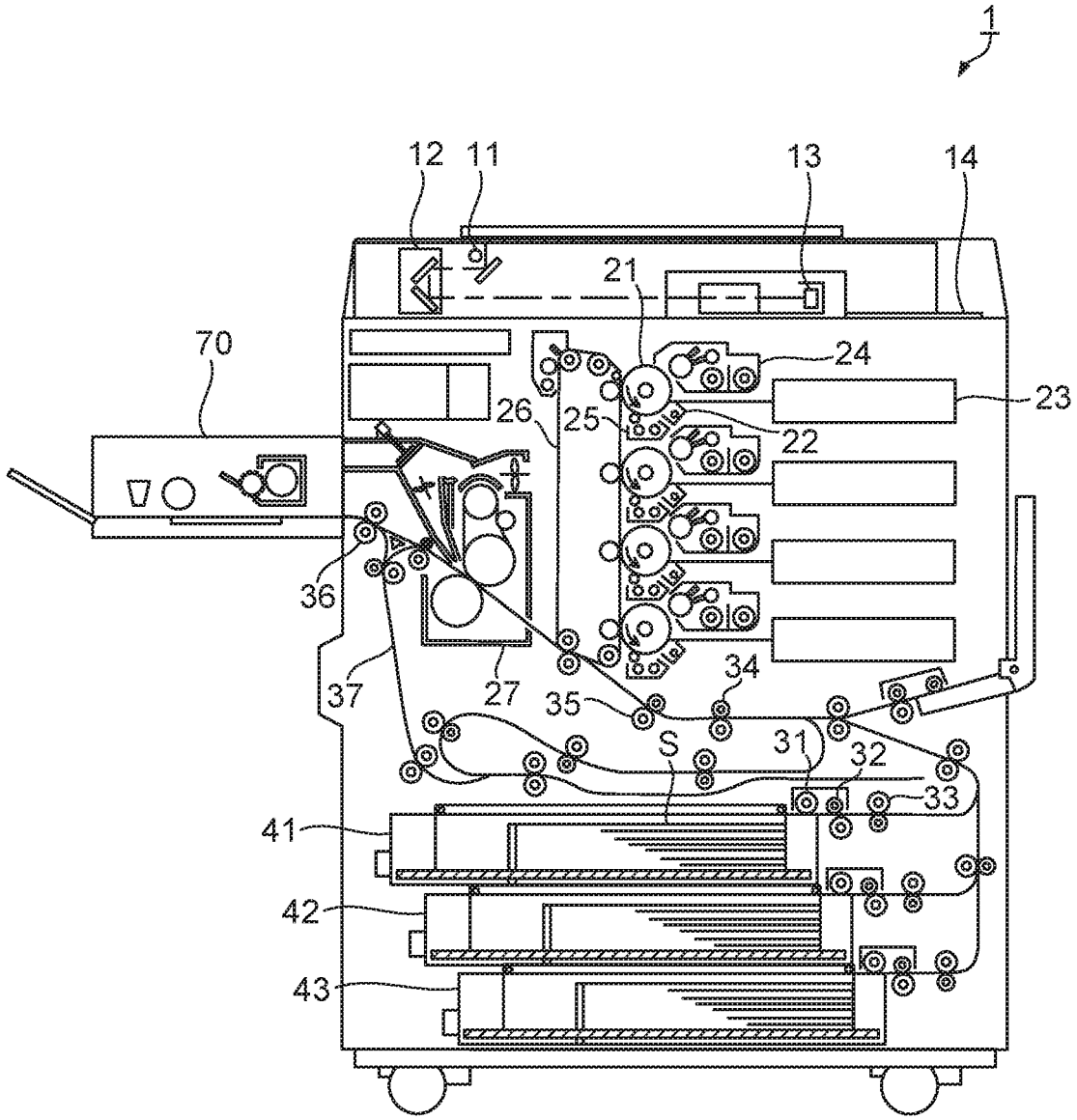
FIG. 1 schematically illustrates configurations of an image forming apparatus of an embodiment of the present invention and an electrophotographic image forming system equipped therewith.

Hereinafter, one or more embodiments of the present invention will be described with reference to the drawings. However, the scope of the invention is not limited to the disclosed embodiments.

Hereinafter, embodiments of the present invention will be described. An image forming apparatus of the embodiment is an image forming apparatus for forming an image by arranging powders on the surface of a resin image.

Such a resin image is composed of a recording medium and a resin layer arranged thereon. In the resin image, the resin layer has been fixed on the recording medium when powders are supplied. As described hereinafter, the resin image can be formed suitably by an electrophotographic image forming method. The forming method of such a resin image, however, is not limited to this.

The recording medium may be appropriately selected from objects that can support the resin layer. Although such a recording medium typically has a sheet shape, the shape is not limited. Examples of such recording media include standard paper ranging from thin paper to cardboard; high-quality paper; coated printing sheets, such as art paper and coated paper; commercial Japanese paper and postcard sheets; plastic films; and fabrics. Colors of the recording media are not limited, and may be appropriately determined corresponding to final images to be formed, for example.

Resins for the resin layer may be selected appropriately from commonly known various resins. Such a resin is preferably a thermoplastic resin.

As such a thermoplastic resin, one or more may be selected appropriately from commonly known reins with thermoplasticity. Examples of such thermoplastic resins include vinyl resins, such as styrenic resins, (meth)acrylic resins, styrene-(meth)acrylic copolymer resins, and olefin resins; polyester resins; polyamide resins; carbonate resins; polyethers, and vinyl acetate resins. In particular, styrenic resins, acrylic resins, or polyester resins are preferable.

The resin image can be formed by a commonly known image forming method, such as dry-mode or wet-mode electrophotography or inkjet recording. In particular, the resin image is preferably formed by electrophotography.

The resin image is adjusted so that the resin layer is in a softened state. The resin image may be adjusted so that the resin layer is in a softened state at least when its surface is rubbed by a rubbing device described hereinafter. A method of adjusting to a state in which the resin layer is softened is not limited particularly. For example, the resin layer may be heated, an overheated resin layer may be cooled, the temperature of a heated resin layer may be maintained, or a solvent may be applied to the resin layer. The resin layer adjusted to be in a softened state exhibits tackiness such that powders supplied onto the surface of the resin layer are aligned in a flat manner by rubbing and then bonded to the surface.

The temperature at which the resin layer softens (hereinafter, also referred to as "rubbing temperature") can be obtained, for example, by gradually elevating the temperature of the resin image at ambient temperature and detecting a temperature at which powders start to stick to the surface of the resin layer. More specifically, the rubbing temperature can be determined by a method including placing a resin image on a hot plate heated to a predetermined temperature with the resin layer (image side) upward, attaching powders to be used to an appropriate coating member, such as a sponge portion of an eye shadow tip, lightly rubbing the surface of the resin layer therewith, and determining whether the powders are attached to the surface of the resin layer.

In the above method, a temperature at which powders start to attach to the surface of the resin layer is investigated by elevating a setting temperature of the hot plate at a predetermined interval, for example at 5° C. A rubbing temperature can be set as an appropriate range from the temperature at which powders start to attach, for example, as a range of up to 5° C. higher temperature from the temperature at which powders start to attach.

A method of applying a solvent to the resin layer is not limited particularly. Examples of such methods of applying a solvent to the resin layer include spraying, a wire-bar method, a doctor blade method, and a coating method using a roller. Solvents to be applied to the resin image are not limited particularly provided that the resin layer is softened. Examples of such solvents include alcohols, such as methanol and ethanol; ketones, such as acetone and methyl ethyl ketone; hydrocarbon solvents, such as pentane and hexane; and tetrahydrofuran.

The image forming apparatus includes a powder supply device and a rubbing device. The powder supply device is not limited provided that a device can supply the powders onto the surface of the resin layer of the resin image. Commonly known devices can be used as the powder supply device corresponding to the properties and conditions of powders. For example, a powder supply means described in Japanese Patent Application Laid-Open No. 2013-178452 can be used as the powder supply device.

The rubbing device is a device for rubbing, from the side of the resin layer, the resin image to which the powders have been supplied. "Rubbing" herein refers to moving relative to the resin layer along the surface of the resin layer on the recording medium while touching the surface. Such rubbing preferably involves pressing in order to align the powders on the surface of the resin layer and enhance adhesion of the powders to the resin layer. "Pressing" herein refers to pressing the surface of the resin layer in a crossing direction (perpendicular direction, for example) relative to the surface of the resin layer.

During the rubbing, in some cases, when a speed of a rubbing portion of the rubbing device relative to the resin image is excessively slow, powders are aligned unsatisfactorily on the surface of the resin layer, whereas when such a speed is excessively fast, powders are attached unsatisfactorily and thus aligned unsatisfactorily on the surface of the resin layer. Accordingly, clearness in expected mirror-like or pearl-like appearance of final images decreases in some cases. In order to satisfactorily attach and align powders to/on the surface of the resin layer, the relative speed is preferably 5 to 500 mm/s.

Further, in the rubbing, when a contact width of the rubbing portion with the surface of the resin layer is excessively narrow, orientation variations of powders tend to arise while the rubbing portion moves along the surface of the resin layer, and thus powders to be attached to the resin layer are aligned unsatisfactorily in some cases. Meanwhile, when the contact width is excessively wide, conveyance of recording media becomes difficult. In order to satisfactorily achieve expected alignment of powders to be attached to the surface of the resin layer and conveying performance of recording media, the contact width is preferably 1 mm to 200 mm as a length in the moving direction of the rubbing portion relative to the resin image.

Moreover, when a pressing force in the pressing is excessively small, adhesive strength of powders weakens in some cases, whereas when the pressing force is excessively large, the resin layer itself is disturbed and/or torque during conveying of the resin image becomes high in some cases. The pressing force is preferably 1 to 30 kPa against the surface of the resin layer in view of smooth realization of conveyance of the resin image, power saving, retention of an image formed on the resin layer, and enhanced adhesive strength of powders.

A rubbing member and a pressing member may be a rotating member or a non-rotating member, such as a reciprocating member or a fixed member. The rubbing member may be a member that comes into contact with a horizontal surface of the resin image and moves relative to the surface in the horizontal direction, or a rotatable roller that comes into contact with the surface of the resin image.

The pressing member is configured so that its surface is movable relative to the surface of the resin layer while pressing the resin image. Rubbing by the pressing member is possible, for example, by rubbing the resin image being conveyed with a fixed pressing member, by rubbing with a roller that rotates at a slower speed than a conveying speed of the resin image, by rubbing with a roller that rotates in the opposite direction to a conveying direction of the resin image, by rubbing with a rotatable roller that is arranged with its rotational axis in the oblique direction relative to a conveying direction of the resin image, or by rubbing with a reciprocating member on the surface of the resin image.

Accordingly, the pressing member may be configured to be movable in different directions relative to the resin image while pressing the surface of the resin layer.

In addition, the pressing member is preferably flexible. The pressing member is flexible so that, for example, the surface of the pressing member deforms so as to conform to the surface shape of the resin image during pressing (conformity to deformation). Examples of such flexible pressing members include a sponge and a brush.

The shape of the above-mentioned powders is not particularly limited, and may be spherical or non-spherical. In view of suitable alignment on the surface of the resin image, the shape of the powders is preferably non-spherical. The non-spherical powders are powders having a shape other than sphere. In order to align and attach powders along/to the surface of the resin layer, the powders preferably have a flat particle shape. The "flat particle shape" of the non-spherical powders herein means a shape with a minor axis to thickness ratio of 5 or more provided that the maximum length of a non-spherical powder particle is defined as a major axis, the maximum length in a direction orthogonal to the major axis as a minor axis, and the minimum length in a direction orthogonal to the major axis as a thickness.

The thickness of the powders is preferably 0.2 to 10 μm and more preferably 0.2 to 3.0 μm in order to fully exert appearance effects due to attachment of aligned powders. An excessively small thickness results in, in some cases, unsatisfactory realization of good orientation state of powders, in which a planar direction defined by the major axis direction and the minor axis direction of powders attached to the surface of the resin layer substantially align along the surface direction of the resin layer. Meanwhile, an excessively large thickness results in, in some cases, peeling off of powders during rubbing of images.

Materials for the powders are not limited. The powders are preferably metal powders or metal oxide powders in order to impart pearl-like or mirror-like appearance as desired appearance of final images. Particles of different two or more materials may be mixed and used as the powders. Further, the powders may be coated, and may be, for example, metal powders surface-coated with a metal oxide or a resin, metal oxide powders surface-coated with a resin or a metal, or resin powders surface-coated with a metal, a metal oxide, or a resin.

The powders may be synthesized ones or commercial products. Examples of the non-spherical powders include SunshineBabe chromium powder, aurora powder, and pearl powder (from GG Corporation Inc.), ICE GEL mirror metal powder (from TAT Inc.), Pika Ace MC shine dust, Effect C (from Kurachi, "Pika Ace" is a registered trademark of the firm), PREGEL magic powder, mirror series (from Pre Anfa, "PREGEL" is a registered trademark of the firm), Bonnail shine powder (from K's Planning Co., Ltd., "Bonnail" is a registered trademark of the firm), ELgee neo (from Oike Imaging, Inc.), and METASHINE (from Nippon Sheet Glass Company, Ltd.). Examples of spherical powders include high-precision UNIBEADS (from Unitika Ltd.) and Fine Sphere (from Nippon Electric Glass Co., Ltd., "Fine Sphere" is a registered trademark of the firm).

The image forming apparatus may include components other than the powder supply device and the rubbing device provided that advantageous effects of the embodiment are obtained. Examples of such other components include a softening device and a powder collecting device.

The softening device is not particularly limited provided that the resin layer of the resin image is softened appropriately. Examples of the softening device include a temperature adjustment device and a solvent application device.

The temperature adjustment device is a device for adjusting the temperature of the resin image to be rubbed with the rubbing device. The temperature adjustment device may be a heating device, a cooling device, or a device having both functions thereof. Commonly known devices may be used as the temperature adjustment device, and the examples include a hot plate, an oven, and a blower.

In a case in which the resin image at a substantially higher temperature than the rubbing temperature is fed to the image forming apparatus, the temperature adjustment device may be a conveying device that conveys the resin image to the rubbing device via the powder supply device at a certain speed or via a certain path such that the temperature of the resin image is adjusted to the rubbing temperature while being conveyed to the rubbing device.

The solvent application device is a device for applying a solvent to the surface of the resin image. The solvent application device may be a spray coating device that applies a solvent as spray or a roller coating device that applies a solvent with a roller. A method using a wire-bar or a doctor blade may also be employed.

The powder collecting device is a device for collecting powders supplied to the surface of the resin layer. In order to prevent contamination of final images with excessive powders and allow reuse of the powders, the powder collecting device is preferably a device that collects residual powders on the surface of the resin image that has been rubbed with the rubbing device. Examples of the powder collecting device include an elastic member, such as a sponge, a brush, or a blade that comes into contact with the surface; a suction device arranged facing the surface; and a container for storing excessive powders fallen from the surface. The powder collecting device may be the above-mentioned pressing member of the rubbing device.

An image forming method of the embodiment may be an image forming method including steps of supplying the powders to a surface of the resin layer of the resin image; and rubbing, from a side of the resin layer, the resin image that have been supplied with the powders and adjusted to be in a softened state. Such an image forming method can be performed by using the above-described image forming apparatus of the embodiment.

The image forming method may further include steps other than the powder supply step and the rubbing step provided that advantageous effects of the embodiment are obtained. Examples of such other steps include a step of forming the resin image and a step of adjusting the temperature of the resin image so as to soften the resin layer. The step of forming the resin image may be performed by a common electrophotographic image forming method. The step of adjusting the temperature may be preferably performed by using the above-mentioned temperature adjustment device.

Hereinafter, the embodiment will be described further with reference to the drawings. A mode in which an image forming apparatus of the embodiment is added, as a surface treatment apparatus, to an electrophotographic image forming apparatus will be described below.

As illustrated in FIG. 1, image forming system 1 includes a toner image forming apparatus and a surface treatment apparatus.

The toner image forming apparatus has a similar configuration to a commonly known color printer and includes, for example, an image reading section, an image forming section, a sheet conveying section, a sheet feeding section, a control section, and fixing section 27.

The image reading section includes light source 11, optical system 12, imaging element 13, and image processing section 14.

The image forming section includes image forming unit Y that forms images of yellow (Y) toner, image forming unit M that forms images of magenta (M) toner, image forming unit C that forms images of cyan (C) toner, image forming unit K that forms images of black (K) toner, and intermediate transfer belt 26. Y, M, C, and K herein represent colors of toner.

Image forming unit Y includes photoconductor drum 21 as a rotator, charging section 22 arranged in the surrounding region of photoconductor drum 21, optical writing section 23, developing section 24, and drum cleaner 25. Image forming units M, C, and K also have a similar configuration to image forming unit Y. Intermediate transfer belt 26 is wound on a plurality of rollers and supported movably.

The sheet conveying section includes feed roller 31, separation roller 32, conveyance roller 33, loop roller 34, registration roller 35, sheet ejection roller 36, and sheet reversing roller 37. The sheet feeding section includes a plurality of sheet feed trays 41, 42, and 43 that store sheets S.

The control section includes a central processing unit (CPU), random access memory (RAM), and read only memory (ROM). A CPU controls the image reading section, the image forming section, the sheet conveying section, the sheet feeding section, and the surface treatment section according to a program stored in ROM, and stores calculated results, for example, in RAM. Moreover, the control section performs control such that externally received print data is analyzed, bitmap image data is generated, and images based on the image data are formed on sheets S.

Figure 2:
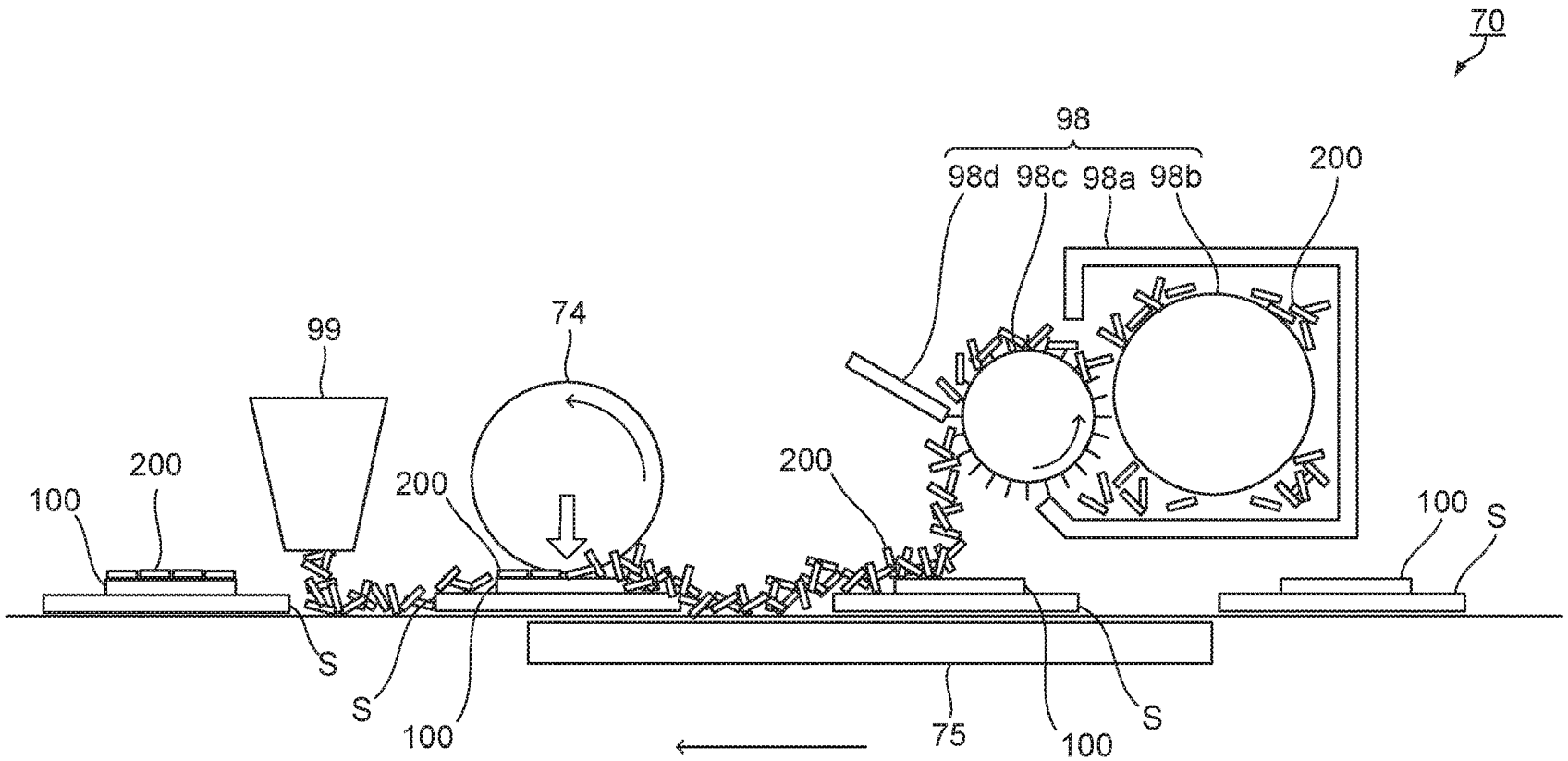
FIG. 2 schematically illustrates a configuration of the image forming apparatus.

The surface treatment device includes powder supply section 70. As illustrated in FIG. 2, powder supply section 70 includes rubbing roller 74, heater 75, powder spraying section 98, and powder collecting section 99.

As a spraying means of powders 200, powder spraying section 98 is a device for spraying powders 200 onto sheets S. Powder spraying section 98 includes container 98*a* for storing powders 200, conveying screw 98*b* for conveying powders 200 to the opening of container 98*a*, brush roller 98*c* for taking powders 200 out of container 98*a*, and flicker 98*d* for flicking powders 200 supported by brush roller 98*c*. Powders 200 each have the above-mentioned flat particle shape.

The opening of container 98*a* is formed in a size so as to come into contact with brush tips of brush roller 98*c* in order to regulate the amount of powders 200 supported by brush roller 98*c*. Flicker 98*d* is a sheet-like member and is arranged in a position so as to come into contact with brush roller 98*c*. A degree of insertion of flicker 98*d* into brush roller 98*c* may be determined by taking account of, for example, a supply amount of powders 200 and/or uneven wear of the brush. Meanwhile, a bristle length and/or brush density of brush roller 98*c* may be determined by taking account of, for example, a supply amount of powers 200 and/or dropping thereof.

Flicker 98*d* may be fixed in a position so as to come into contact with brush roller 98*c*. Alternatively, flicker 98*d* may be configured to be movable so as to separate from brush roller 98*c* while brush roller 98*c* is stopped.

Rubbing roller 74 has its rotational axis in the perpendicular direction to the conveying direction of sheets S (perpendicular direction to the plane of the figure), and is configured to be rotatable in the arrow direction in the figure and to be thrusted by a thrusting member (not shown). Rubbing roller 74 includes, for example, a cylindrical core and an elastic layer of a resin sponge or the like arranged on the outer peripheral surface of the core. The length of rubbing roller 74 in the axial direction is longer than the width of sheets S.

Heater 75 is arranged in a position facing rubbing roller 74. Heater 75 is a hot plate, for example.

Powder collecting section 99 is, for example, a powder collector for sucking excessive powders 200 supplied from powder spraying section 98. The powder collector is arranged so that its sucking port is positioned at an appropriate height from a conveying path of sheets S, and is configured to operate at appropriate output so as to suck powders 200, but not sheets S.

In image forming system 1, the control section controls the image reading section, image forming section, the sheet conveying section, the sheet feeding section, and the surface treatment device.

In the image reading section, a document placed on a reading surface is irradiated with light emitted from light source 11, and the reflected light is imaged, via a lens and a reflecting mirror of optical system 12, on imaging element 13 that has been moved to a reading position. Imaging element 13 generates electrical signals corresponding to the intensity of reflected light from the document. The generated electrical signals are converted from analog signals into digital signals, then undergo correction processing, filtering processing, and image compression processing, for example, and are stored as image data in a memory of image processing section 14. The image reading section thus reads images on documents and stores image data.

In the image forming section, photoconductor drum 21 is rotated at a predetermined speed by a drum motor. Charging section 22 charges the surface of photoconductor drum 21 at a desired potential, and optical writing section 23 writes image information signals on photoconductor drum 21 on the basis of image data so as to form, on photoconductor drum 21, latent images based on the image information signals. Such latent images are developed by developing device 24 to form toner images, which are visible images, on photoconductor drum 21. Accordingly, yellow, magenta, cyan, and black unfixed toner images are formed on respective photoconductor drums 21 of YMCK image forming units. The image forming section thus forms toner images through an electrophotographic image forming process.

Color toner images formed by YMCK image forming units are successively transferred to running intermediate transfer belt 26 by primary transfer sections. Consequently, color toner images of superimposed yellow, magenta, cyan, and black color toner layers are formed on intermediate transfer belt 26.

In the sheet conveying section, sheets S are sent out one by one to a conveying path by feed roller 31 and separation roller 32 from sheet feed trays 41, 42, and 43 in the sheet feeding section. Sheet S sent out to the conveying path is conveyed by conveyance roller 33 along the conveying path to a secondary transfer roller via loop roller 34 and registration roller 35. Color toner images on intermediate transfer belt 26 are then transferred to sheet S.

In fixing section 27, color toner images on sheet S are fixed to sheet S as a color toner layer by applying heat and pressure to sheet S to which the color toner images have been transferred. Consequently, a resin layer 100 is formed on sheet S. Sheet S having resin layer 100 is sent to the surface treatment device via sheet ejection roller 36.

Meanwhile, sheet S that has undergone fixing may be guided to sheet reversing section 37 to reverse the sides of sheet S and ejected. Images can thus be formed on both sides of sheet S.

In powder supply section 98, powders 200 stored in container 98*a* are conveyed to brush roller 98*c* by conveying screw 98*b*. Brush roller 98*c*, for example, rotates counterclockwise so as to hold powders 200. Powders 200 held by brush roller 98*c* are flicked by flicker 98*d* and sprayed on sheet S and resin layer 100.

Resin layer 100 on sheet S is heated from the rear side of sheet S by heater 75. Through heating, resin layer 100 softens appropriately, thereby imparting adhesive force to the surface of resin layer 100.

Rubbing roller 74 is thrusted against sheet S and rotated in the arrow direction in the figure. Rubbing roller 74 rotates in the opposite direction to the conveying direction of sheet S. Rubbing roller 74 rotates while pressing powders 200 on resin layer 100 with an appropriate force (about 10 kPa, for example) so that the surface of rubbing roller 74 rubs the surface of resin layer 100 to which powders 200 have been supplied. Since the surface of resin layer 100 with tackiness is supplied with powders 200 and rubbed by rubbing roller 74, powders 200 are aligned in a direction along the surface of resin layer 100 and attached to the surface.

Figure 3A:
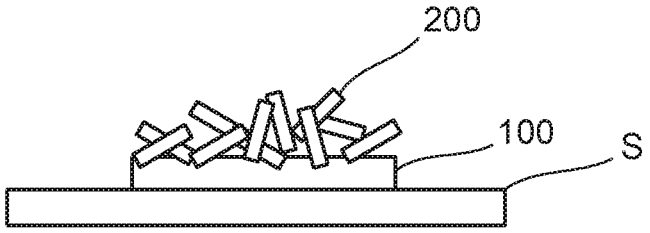
FIG. 3A schematically illustrates a state of powders supplied onto a toner layer before rubbing, whereas FIG. 3B schematically illustrates a state of the powders on the toner layer after rubbing.

More specifically, when powders 200 are supplied to the surface of resin layer 100, powders 200 are not aligned as illustrated in FIG. 3A. In the embodiment, however, powders have a flat particle shape. Accordingly, powders 200 tend to be aligned along a plane defined by the major axis and the minor axis (a plane orthogonal to the thickness direction). Moreover, powders 200 on resin layer 100 are rubbed while being pressed appropriately by rubbing roller 74.

Figure 3B:
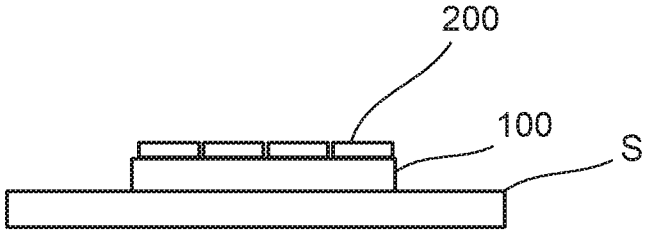

Part of powders 200 without direct contact with resin layer 100 are removed from the surface of resin layer 100 by rubbing with rubbing roller 74. Accordingly, powders 200 are aligned along and attached to the surface of resin layer 100 as illustrated in FIG. 3B. Sheet S having resin layer 100 to which powders 200 have been thus supplied is cooled to room temperature, for example, to fix powders 200 to resin layer 100. Consequently, an image including sheet S, resin layer 100, and a layer of powders 200 in this order is finally formed.

Among powders 200 sprayed onto sheet S, excessive powders 200 present in a portion where the resin layer is not formed are sucked into a powder collector by air flow generated by the powder collector and removed from sheet S, resin layer 100, and the conveying path.

As in the foregoing, powders 200 are fallen on the surface of resin layer 100 by rubbing, and thus the planar direction of powders 200 are aligned substantially parallel to the surface. Only powders 200 to which the adhesive force due to tackiness of resin layer 100 is exerted are attached to resin layer 100 and remain on the surface.

Powders 200 are thus attached, substantially as a single layer, to the surface of resin layer 100 by rubbing. The surface of resin layer 100 is not completely covered by powders 200. For example, a hiding rate of the surface by powders 200 is about 60%.

Therefore, mirror-like or pear-like appearance in a final image is obtained as appearance of combined visual effects by the layer of powders 200 and visual effects by sheet S and an image of a toner layer (background image).

The appearance of a final image is controlled by combinations of the appearance of powders and the saturation of a background image. For example, when the powders have metallic luster, final images tend to exhibit mirror-like appearance at a low saturation of the background image and pearl-like appearance at a high saturation of the background image. Meanwhile, when the powders have appearance other than metallic luster, such as iridescence, final images tend to exhibit pearl-like appearance regardless of a saturation of the background image.

When powders with metallic luster are used, a boundary value for a saturation of the background image that determines the appearance of final images cannot be expressed with certainty since it is, in some cases, affected by various conditions, such as the size of an image and a color of a neighboring portion to the background image portion to which powders are attached. In general, however, final images tend to exhibit pearl-like appearance when a saturation of the background image is 30 or more and exhibit mirror-like appearance when a saturation is less than 30. The saturation of the background image can be measured according to measurement conditions below.

[Measurement Conditions]

Measuring apparatus: FD-7 (from Konica Minolta, Inc.)

Light source: D 50

Background: white

Although the above-described image forming apparatus of the illustrated embodiment is combined with an electrophotographic color printer, the image forming apparatus itself may be independent. Alternatively, the image forming apparatus may be built in the color printer as one body.

As is clear from the above description, the image forming apparatus of the embodiment is an image forming apparatus for forming an image by arranging powders on a surface of a resin image composed of a recording medium and a resin layer arranged thereon, and includes: a powder supply device for supplying the powders to a surface of the resin layer of the resin image in which the resin layer is adjusted to be in a softened state; and a rubbing device for rubbing, from a side of the resin layer, the resin image to which the powders have been supplied. The image forming method of the embodiment includes supplying powders to a surface of a resin layer in which the resin layer is adjusted to be in a softened state, where the resin image is composed of a recording medium and the resin layer arranged thereon; and rubbing, from a side of the resin layer, the resin image to which the powders have been supplied. According to the embodiment, mirror-like or pearl-like appearance can be imparted only to the resin layer portion when non-spherical powders with metallic luster or pearlescence are used. Consequently, images having a mirror-like or pearl-like appearance in a desired portion can be formed. When non-spherical powders without metallic luster or pearlescence, or spherical powders are used, gloss of the resin layer portion is changeable.

The rubbing device may include a pressing member for pressing the resin image from a side of the resin layer, and the pressing member may be configured to be movable relative to the surface of the resin layer while pressing the resin image. Such a configuration is further effective from a viewpoint of enhancing adhesive force of the powders to the resin layer.

The pressing member may be configured to be movable in a direction different from a conveying direction of the resin image being conveyed or the pressing member may be movable on the resin layer by a reciprocating motion. Such a configuration is further effective from a viewpoint of aligning the powders as a single layer on the surface of the resin layer.

The pressing member with flexibility is more effective, and the pressing member being a sponge is further effective in view of preservation of the resin layer and appropriate alignment of the powders.

The powders may each have a flat particle shape or may have a minor axis of 0.2 to 3.0 μm. Such a configuration is further effective from a viewpoint of controlling alignment of the powders on the resin layer so as to achieve suitable alignment.

The powders may be either metal powders or metal oxide powders, or both metal powders and metal oxide powders. Such a configuration is further effective from a viewpoint of obtaining clearer pearl-like or mirror-like appearance in final images.

The image forming apparatus may further include a softening device for softening the resin layer of the resin image to be rubbed by the rubbing device, or may further involve a step of softening the resin layer of the resin image to be rubbed. Such a configuration is further effective from a viewpoint of satisfactorily attaching the powders to the surface of the resin layer.

The image forming apparatus may further include a powder collecting device for collecting the powders supplied to the surface of the resin layer. Such a configuration is further effective from a viewpoint of decreasing an environmental load in formation of final images.

EXAMPLES

[Preparation of Black Dispersion]

Into 160 parts by weight of deionized water, 11.5 parts by weight of sodium n-dodecyl sulfate was fed, dissolved, and stirred to prepare a surfactant aqueous solution. Into the surfactant aqueous solution, 15 parts by weight of a coloring agent (carbon black: Mogul L) was added slowly and dispersed by using "CLEARMIX W-Motion CLM-0.8" (from M Technique Co., Ltd., "CLEARMIX" is a registered trademark of the firm) to prepare a dispersion of fine particles of the black coloring agent (black dispersion).

The particle size of the fine particles of the black coloring agent in the black dispersion was 220 nm as a volume-based median diameter. The volume-based median diameter was obtained by measuring with "Microtrac UPA-150" (from Honeywell International, Inc.) under the following measurement conditions.

Refractive index of sample: 1.59

Specific gravity of sample: 1.05 (as spherical particle)

Refractive index of solvent: 1.33

Viscosity of solvent: 0.797 (30° C.), 1.002 (20° C.)

Zero-point adjustment: adjusted by feeding deionized water into a measurement cell

[Preparation of Yellow Dispersion]

A dispersion of fine particles of a yellow coloring agent (yellow dispersion) was prepared in a similar manner to the preparation of the black dispersion except for using "C.I. Pigment Yellow 74" in place of "carbon black: Mogul L."

[Preparation of Magenta Dispersion]

A dispersion of fine particles of a magenta coloring agent (magenta dispersion) was prepared in a similar manner to the preparation of the black dispersion except for using "C.I. Pigment Red 122" in place of "carbon black: Mogul L."

[Preparation of Cyan Dispersion]

A dispersion of fine particles of a cyan coloring agent (cyan dispersion) was prepared in a similar manner to the preparation of the black dispersion except for using "C.I. Pigment Blue 15:3" in place of "carbon black: Mogul L."

[Preparation of White Dispersion]

A dispersion of fine particles of a white coloring agent (white dispersion) was prepared in a similar manner to the preparation of the black dispersion except for using "SA-1" titanium oxide particles (from Sakai Chemical Industry Co., Ltd.) in place of "carbon black: Mogul L."

The particle size of the fine particles of the yellow coloring agent in the yellow dispersion was 140 nm as median diameter as described above. The median diameter of the fine particles of the magenta coloring agent in the magenta dispersion was 130 nm. The median diameter of the fine particles of the cyan coloring agent in the cyan dispersion was 110 nm. The median diameter of the fine particles of the white coloring agent in the white dispersion was 150 nm.

[Preparation of Core Resin Particles]

Core resin particles each having a multilayer structure were prepared through first-stage polymerization, second-stage polymerization, and third-stage polymerization described below.

(a) First-Stage Polymerization

Into a reaction vessel equipped with a stirrer, a temperature sensor, a condenser, and a nitrogen inlet device, surfactant aqueous solution 1, in which 4 parts by weight of polyoxyethylene 2-dodecyl ether sulfate sodium salt is dissolved in 3,040 parts by weight of deionized water, was fed and the temperature of the solution was elevated to 80° C. with stirring at a stirring speed of 230 rpm under stream of nitrogen.

To surfactant aqueous solution 1, polymerization initiator solution 1, in which 10 parts by weight of potassium persulfate is dissolved in 400 parts by weight of deionized water, was added, the temperature of the resulting mixture was elevated to 75° C., and then monomer mixture 1 containing the following components in amounts described below was added dropwise to the resulting mixture over 1 hour.

| | |
|---|---|
| Styrene | 532 parts by weight |
| n-Butyl acrylate | 200 parts by weight |
| Methacrylic acid | 68 parts by weight |
| n-Octylmercaptan | 16.4 parts by weight |

After the dropwise addition of monomer mixture 1, the obtained reaction mixture was polymerized through heating and stirring at 75° C. for 2 hours (first-stage polymerization) to yield resin particles A1.

(b) Second-Stage Polymerization

Into a flask equipped with a stirrer, monomer mixture 2 containing the following components in amounts described below was fed, and 93.8 parts by weight of "HNP-57" paraffin wax (from Nippon Seiro Co., Ltd.) was added as a release agent and dissolved by heating to 90° C.

| | |
|---|---|
| Styrene | 101.1 parts by weight |
| n-Butyl acrylate | 62.2 parts by weight |
| Methacrylic acid | 12.3 parts by weight |
| n-Octylmercaptan | 1.75 parts by weight |

Meanwhile, surfactant aqueous solution 2, in which 3 parts by weight of polyoxyethylene 2-dodecyl ether sulfate sodium salt is dissolved in 1,560 parts by weight of deionized water, was heated to 98° C. To surfactant aqueous solution 2, 32.8 parts by weight of resin particles A1 were added, further monomer mixture 2 was added, and then mixed and dispersed for 8 hours by using a "CLEARMIX" mechanical disperser with a circulation path (from M technique Co., Ltd.). Through the mixing and dispersing, emulsion particle dispersion 1 containing emulsion particles with a dispersion particle diameter of 340 nm was prepared.

Subsequently, polymerization initiator solution 2, in which 6 parts by weight of potassium persulfate is dissolved in 200 parts by weight of deionized water, was added to emulsion particle dispersion 1, and the obtained mixture was polymerized through heating and stirring at 98° C. for 12 hours (second-stage polymerization) to yield resin particles A2 and thus a dispersion containing resin particles A2.

(c) Third-Stage Polymerization

To the dispersion containing resin particles A2, polymerization initiator solution 3, in which 5.45 parts by weight of potassium persulfate is dissolved in 220 parts by weight of deionized water, was added, and monomer mixture 3 containing the following components in amounts described below was added dropwise over 1 hour to the obtained dispersion at a temperature of 80° C.

| | |
|---|---|
| Styrene | 293.8 parts by weight |
| n-Butyl acrylate | 154.1 parts by weight |
| n-Octylmercaptan | 7.08 parts by weight |

After the dropwise addition, the resulting mixture was polymerized through heating and stirring for 2 hours (third-stage polymerization) and cooled to 28° C. after the end of the polymerization to yield core resin particles.

[Preparation of Shell Resin Particles]

Shell resin particles were prepared by performing a polymerization reaction and post-reaction processing in a similar manner to the first-stage polymerization in preparation of the core resin particles except for changing monomer mixture 1 to monomer mixture 4 containing the following components in amounts described below.

| | |
|---|---|
| Styrene | 624 parts by weight |
| 2-Ethylhexyl acrylate | 120 parts by weight |
| Methacrylic acid | 56 parts by weight |
| n-Octylmercaptan | 16.4 parts by weight |

[Preparation of Black Toner Particles]

(a) Preparation of Core Parts

Into a reaction vessel equipped with a stirrer, a temperature sensor, a condenser, and a nitrogen inlet device, the following components were fed in amounts described below and stirred. The temperature of the obtained mixture was adjusted to 30° C., and then 5 mol/L of a sodium hydroxide aqueous solution was added to the mixture to adjust the pH to 8 to 11.

| | |
|---|---|
| Core resin particles | 420.7 parts by weight |
| Deionized water | 900 parts by weight |
| Black dispersion | 300 parts by weight |

Subsequently, an aqueous solution of 2 parts by weight of magnesium chloride hexahydrate dissolved in 1,000 parts by weight of deionized water was added to the above mixture over 10 minutes at 30° C. with stirring. By starting elevating the temperature of the mixture after the mixture was left standing for 3 minutes and by elevating the temperature over 60 minutes to 65° C., particles in the mixture were associated. In this state, a particle size of the associated particles was measured by using "Multisizer 3" (from Beckman Coulter, Inc.), and the association process of the particles was terminated by adding an aqueous solution of 40.2 parts by weight of sodium chloride dissolved in 1,000 parts by weight of deionized water when a volume-based median diameter of the associated particles reached 5.8 μm.

After termination of the association process, the resulting mixture was aged by heating over 1 hour at the liquid temperature of 70° C. with stirring so as to continue fusing of the associated particles, thereby forming core parts. An average circularity of the core parts was 0.912 in the measurement using "FPIA2100" (from Sysmex Corporation, "FPIA" is a registered trademark of the firm).

(b) Preparation of Shells

Next, the above mixture was adjusted to 65° C., 50 parts by weight of shell resin particles were added to the mixture, and an aqueous solution of 2 parts by weight of magnesium chloride hexahydrate dissolved in 1,000 parts by weight of deionized water was further added to the mixture over 10 minutes. Subsequently, the temperature of the resulting mixture was elevated to 70° C. and stirred over 1 hour, thereby fusing the shell resin particles on the surface of the core parts. The mixture was then aged at 75° C. for 20 minutes to form shells.

After that, the forming process of the shells was terminated by adding an aqueous solution of 40.2 parts by weight of sodium chloride dissolved in 1,000 parts by weight of deionized water. Further, the resulting mixture was cooled to 30° C. at a rate of 8° C./min. The formed particles were filtered, repeatedly washed with deionized water at 45° C., and then dried with warm air at 40° C. to yield black toner base particles each composed of the core part surface-covered with the shell.

(c) Addition Step of External Additives

The following external additives were added to the black toner base particles and processed with a "Henschel Mixer" (from NIPPON COKE & ENGINEERING Co., Ltd.) to yield black toner particles.

| | |
|---|---|
| Hexamethyldisilazane-treated silica fine particles | 0.6 parts by weight |
| n-Octylsilane-treated titanium dioxide fine particles | 0.8 parts by weight |

Processing with the Henschel mixer was performed at a peripheral speed of the impeller blade of 35 m/s and a processing temperature of 35° C. for a processing time of 15 minutes. As for the above external additives, the particle size of the silica fine particles was 12 nm as volume-average median diameter, and the particle size of the titanium dioxide fine particles was 20 nm as volume-average median diameter.

[Preparation of Yellow Toner Particles]

Yellow toner particles were prepared in a similar manner to the preparation of the black toner particles except for using the yellow dispersion in place of the black dispersion.

[Preparation of Magenta Toner Particles]

Magenta toner particles were prepared in a similar manner to the preparation of the black toner particles except for using the magenta dispersion in place of the black dispersion.

[Preparation of Cyan Toner Particles]

Cyan toner particles were prepared in a similar manner to the preparation of the black toner particles except for using the cyan dispersion in place of the black dispersion.

[Preparation of White Toner Particles]

White toner particles were prepared in a similar manner to the preparation of the black toner particles except for using the white dispersion in place of the black dispersion.

[Preparation of Clear Toner Particles]

Clear toner particles were prepared in a similar manner to the preparation of the black toner particles except for using a surfactant aqueous solution of 18.5 parts by weight of sodium n-dodecyl sulfate mixed with 281.5 parts by weight of deionized water in place of the black dispersion.

[Preparation of Developers]

A black developer, a yellow developer, a magenta developer, a cyan developer, a white developer, and a clear developer were each prepared by mixing the black toner particles, the yellow toner particles, the magenta toner particles, the cyan toner particles, the white toner particles, and the clear toner particles with ferrite carrier particles (volume-average particle size 40 μm) surface-coated with methyl methacrylate-cyclohexyl methacrylate copolymer in an amount to achieve a toner concentration of 6 mass %, respectively.

[Preparation of Recording Media 1 to 6]

Recording media 1 to 6 below were prepared.

Recording medium 1: "Newcolor R snow" (from LINTEC Corporation)

Recording medium 2: "Newcolor R sunflower" (from LINTEC Corporation)

Recording medium 3: "Newcolor R peony" (from LINTEC Corporation)

Recording medium 4: "Newcolor R green" (from LINTEC Corporation)

Recording medium 5: "Newcolor R black" (from LINTEC Corporation)

Recording medium 6: "OHP film (for color laser & color copy)" (from KOKUYO Co., Ltd.)

[Preparation of Powders 1 to 3]

Powders 1 to 3 below were prepared. Both powders 1 and 2 were non-spherical powders having a flat particle shape. Powders 1 were metal powders. Powders 3 were spherical powders.

Powders 1: "SunshineBabe D-9 chromium powder" (from GG Corporation Inc.)

Powders 2: "SunshineBabe D-11 aurora powder" (from GG Corporation Inc.)

Powders 3: "UBS-0010E" borosilicate glass beads (from UNITIKA Ltd.)

Example 1

The black developer and recording medium 1 were set in modified "AccurioPress C2060" (from Konica Minolta, Inc., "AccurioPress" is a registered trademark of the firm), a patch image of 2 cm×2 cm square was formed on recording medium 1, and a toner image (resin image) having the patch image on recording medium 1 was output. The patch image portion of the resin image showed black color.

The resin image was placed with the patch image upward on a hot plate heated at 80° C., powders 1 were sprayed on the patch image, and the surface of the patch image of the resin image was rubbed with a sponge roller. The pressing force during rubbing was about 10 kPa. The resin image was cooled at room temperature after rubbing, and then excessive powders 1 were removed from the surface of the patch image with a brush. The thus-obtained patch image portion of the resin image (final image) exhibited mirror-like appearance.

The appearance of final images was visually observed by 10 skilled technicians and evaluated according to four categories below. Evaluations were made unanimously for all Examples and Comparative Examples.

1: evaluated as a mirror-like image
2: evaluated as a pear-like image
3: evaluated as matt image
4: evaluated as none of them

Example 2

A final image of a resin image was obtained in a similar manner to Example 1 except for using the magenta developer in place of the black developer to form a magenta patch image on recording medium 1 in the resin image. The final image exhibited magenta pearl-like appearance.

Example 3

A final image of a resin image was obtained in a similar manner to Example 1 except for setting the yellow developer and the cyan developer in respective developing devices and using them in place of the black developer to form a green patch image on recording medium 1 in the resin image. The final image exhibited green pearl-like appearance.

Example 4

A final image of a resin image was obtained in a similar manner to Example 1 except for using the white developer in place of the black developer to form a white patch image on recording medium 1 in the resin image. The final image exhibited mirror-like appearance.

Example 5

A final image of a resin image was obtained in a similar manner to Example 1 except for using the clear developer in place of the black developer to form a white patch image on recording medium 1 in the resin image. The final image exhibited mirror-like appearance.

Example 6

A final image of a resin image was obtained in a similar manner to Example 1 except for using recording medium 2 in place of recording medium 1 and using the clear developer in place of the black developer to form a yellow patch image on recording medium 2 in the resin image. The final image exhibited yellow pearl-like appearance.

Example 7

A final image of a resin image was obtained in a similar manner to Example 1 except for using recording medium 3 in place of recording medium 1 and using the cyan developer in place of the black developer to form a blue patch image on recording medium 3 in the resin image. The final image exhibited blue pearl-like appearance.

Example 8

A final image of a resin image was obtained in a similar manner to Example 1 except for using recording medium 4 in place of recording medium 1 and using the magenta developer in place of the black developer to form a black patch image on recording medium 4 in the resin image. The final image exhibited mirror-like appearance.

Example 9

A final image of a resin image was obtained in a similar manner to Example 1 except for using recording medium 5 in place of recording medium 1 and using the white developer in place of the black developer to form a white patch image on recording medium 5 in the resin image. The final image exhibited mirror-like appearance.

Example 10

A final image of a resin image was obtained in a similar manner to Example 1 except for using recording medium 6 in place of recording medium 1 to form a black patch image on recording medium 6 in the resin image. The final image exhibited mirror-like appearance.

Example 11

A final image of a resin image was obtained in a similar manner to Example 1 except for using recording medium 6 in place of recording medium 1 and using the cyan developer in place of the black developer to form a cyan patch image on recording medium 6 in the resin image. The final image exhibited cyan pearl-like appearance.

Example 12

A final image of a resin image was obtained in a similar manner to Example 1 except for using recording medium 6 in place of recording medium 1, setting the yellow developer and magenta developer in respective developing devices, and using them in place of the black developer to form a red patch image on recording medium 6 in the resin image. The final image exhibited red pearl-like appearance.

Example 13

A final image of a resin image was obtained in a similar manner to Example 1 except for using recording medium 6 in place of recording medium 1 and using the white developer in place of the black developer to form a white patch image on recording medium 6 in the resin image. The final image exhibited mirror-like appearance.

Example 14

A final image of a resin image was obtained in a similar manner to Example 1 except for using the white developer in place of the black developer to form a white patch image on recording medium 1 in the resin image, and using powders 2 in place of powders 1. The final image exhibited white pearl-like appearance.

Example 15

A final image was obtained in a similar manner to Example 1 except for spraying tetrahydrofuran so as to have a coating thickness of 1 μm using a spray coating device as an image softening means, and drying at room temperature in place of cooling. The final image exhibited mirror-like appearance.

Example 16

A final image was obtained in a similar manner to Example 1 except for using powders 3 in place of powders 1. The final image exhibited matt appearance.

Comparative Examples 1 and 2

Final images (Comparative Examples 1 and 2) of resin images were obtained in a similar manner to Examples 1 and 2, respectively, except for pressing patch images to which powders 1 had been supplied without rubbing with a sponge roller. The final images of Comparative Examples 1 and 2 exhibited none of mirror-like, pearl-like, and matt appearance.

Table 1 shows image formation conditions and the appearance of obtained final images for Examples and Comparative Examples.

TABLE 1

| | Recording medium No. | Developer color | Image color | Powders No. | Rubbing | Appearance of final image |
|---|---|---|---|---|---|---|
| Ex. 1 | 1 | Black | Black | 1 | Done | Mirror-like |
| Ex. 2 | 1 | Magenta | Magenta | 1 | Done | Pearl-like (magenta) |
| Ex. 3 | 1 | Yellow, Cyan | Green | 1 | Done | Pearl-like (green) |
| Ex. 4 | 1 | White | White | 1 | Done | Mirror-like |
| Ex. 5 | 1 | Clear | White | 1 | Done | Mirror-like |
| Ex. 6 | 2 | Clear | Yellow | 1 | Done | Pearl-like (yellow) |
| Ex. 7 | 3 | Cyan | Blue | 1 | Done | Pearl-like (blue) |
| Ex. 8 | 4 | Magenta | Black | 1 | Done | Mirror-like |
| Ex. 9 | 5 | White | White | 1 | Done | Mirror-like |
| Ex. 10 | 6 | Black | Black | 1 | Done | Mirror-like |
| Ex. 11 | 6 | Cyan | Cyan | 1 | Done | Pearl-like (cyan) |
| Ex. 12 | 6 | Yellow, Magenta | Red | 1 | Done | Pearl-like (red) |
| Ex. 13 | 6 | White | White | 1 | Done | Mirror-like |
| Ex. 14 | 1 | White | White | 2 | Done | Pearl-like (white) |
| Ex. 15 | 1 | Black | Black | 1 | Done | Mirror-like |
| Ex. 16 | 1 | Black | Black | 3 | Done | Matt |
| Comp. Ex. 1 | 1 | Black | Black | 1 | None | — |
| Comp. Ex. 2 | 1 | Magenta | Magenta | 1 | None | — |

As is clear from Table 1, final images with mirror-like or pearl-like appearance were obtained in Examples 1 to 15. These Examples reveal that when powders with metallic luster, such as chromium powders, are used, final images exhibit mirror-like appearance at a low saturation of a toner image of a resin image and pearl-like appearance at a high saturation of such a toner image. In this case, a final image with pearl-like appearance exhibits a color of a resin image before powders are supplied (a color of a toner image, a combined color of a toner image color and a recording medium color, or a color in the same category).

Meanwhile, it is revealed that even when a saturation of a toner image of a resin image is low, a final image exhibits pearl-like appearance when pearlescent powders without metallic luster (iridescent powders) are used. It is further revealed that a matt image is obtained when spherical powders are used (Example 16).

In contrast, none of mirror-like, pearl-like, and matt appearance was realized in Comparative Examples 1 and 2. It is believed that this is because powders were not aligned on patch images since the powders were pressed without being rubbed after powders had been supplied onto the patch images.

INDUSTRIAL APPLICABILITY

According to the present invention, images with special appearance, such as pearl-like, mirror-like, or matt appearance, can be formed in a desired position corresponding to the arrangement of a resin layer as a base. Such a resin layer can be formed by an electrophotographic image forming apparatus. Therefore, according to the present invention, formation of images with the above-mentioned special appearance is expected to be employed further widely.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus for forming an image by arranging powders on a surface of a resin image composed of a recording medium and a resin layer arranged on the recording medium, the apparatus comprising:

a powder supply device for supplying the powders to a surface of the resin layer of the resin image in which the resin layer is adjusted to be in a softened state; and a rubbing device for rubbing, from a side of the resin layer, the resin image to which the powders have been supplied, wherein:

a surface of the rubbing device that contacts the resin image and the resin image being conveyed move at a relative speed of 5 to 500 mm/s.

2. The image forming apparatus according to claim 1, wherein:

the rubbing device includes a press for pressing the resin image from the side of the resin layer; and the press is configured so that a surface of the press that presses the resin image is movable relative to the surface of the resin layer while pressing the resin image.

3. The image forming apparatus according to claim 2, wherein the press is configured so as to be movable in a direction different from a conveying direction of the resin image being conveyed.

4. The image forming apparatus according to claim 2, wherein the press is movable on the resin layer by a reciprocating motion.

5. The image forming apparatus according to claim 2, wherein the press is flexible.

6. The image forming apparatus according to claim 2, wherein the press is a sponge.

7. The image forming apparatus according to claim 1, wherein the powders each have a flat particle shape.

8. The image forming apparatus according to claim 1, wherein a thickness of the powders is 0.2 to 3.0 μm.

9. The image forming apparatus according to claim 1, wherein the powders are either metal powders or metal oxide powders, or both metal powders and metal oxide powders.

10. The image forming apparatus according to claim 1, further comprising a softening device for softening the resin layer of the resin image which is to be rubbed by the rubbing device.

11. The image forming apparatus according to claim 1, further comprising a powder collector for collecting the powders supplied to the surface of the resin layer.

12. The image forming apparatus according to claim 1, wherein the powders are non-spherical powders and the resin layer is a layer of a thermoplastic resin.

13. The image forming apparatus according to claim 1, wherein the rubbing device is a fixed pressing member that rubs the resin image being conveyed.

14. An image forming method comprising:

supplying powders to a surface of a resin layer of a resin image in which the resin layer is adjusted to be in a softened state, the resin image being composed of a recording medium and the resin layer arranged on the recording medium; and rubbing, from a side of the resin layer, the resin image to which the powders have been supplied, wherein:

rubbing is done by a rubbing device and a surface of the rubbing device that contacts the resin image and the resin image being conveyed move at a relative speed of 5 to 500 mm/s.

15. The image forming method according to claim 14, further comprising softening the resin layer of the resin image to be rubbed.

16. The image forming method according to claim 14, wherein in the rubbing, a flexible part is used as a press for rubbing.

17. The image forming method according to claim 14, wherein in the rubbing, a sponge is used as a press for rubbing.

18. The image forming method according to claim 14, wherein the powders each have a flat particle shape.

19. The image forming method according to claim 14, wherein a thickness of the powders is 0.2 to 3.0 μm.

20. The image forming method according to claim 14, wherein the powders are either metal powders or metal oxide powders, or both metal powders and metal oxide powders.

21. The image forming method according to claim 14, further comprising collecting the powders supplied to the surface of the resin layer.

22. The image forming method according to claim 14, wherein the powders are non-spherical powders.

23. The image forming method according to claim 14, wherein the resin layer is adjusted to be in a softened state by adjusting a temperature of the resin layer to a softening temperature.

24. The image according to claim 14, wherein the powders are non-spherical powders and the resin layer is a layer of a thermoplastic resin.

25. The image forming method according to claim 14, wherein the rubbing device is a fixed pressing member that rubs the resin image being conveyed.

26. An image forming apparatus for forming an image by arranging powders on a surface of a resin image composed of a recording medium and a resin layer arranged on the recording medium, the apparatus comprising:

a powder supply device for supplying the powders to a surface of the resin layer of the resin image in which the resin layer is adjusted to be in a softened state; and a rubbing device for rubbing, from a side of the resin layer, the resin image to which the powders have been supplied, wherein a surface of the rubbing device that contacts the resin image moves in an opposite direction from a conveying direction of the resin image being conveyed.

* * * * *